United States Patent [19]

Davis

[11] 3,947,533

[45] Mar. 30, 1976

[54] MAGNETIC FIELD EXPANSION AND COMPRESSION METHOD

[75] Inventor: Albert Roy Davis, Green Cove Springs, Fla.

[73] Assignee: BioMagnetics, International Inc., Jacksonville, Fla.

[22] Filed: June 14, 1974

[21] Appl. No.: 479,544

[52] U.S. Cl. ..... 264/24; 164/49

[51] Int. Cl.[2] ..... B22D 27/02

[58] Field of Search ..... 75/10; 164/49, 250, 146, 164/147; 264/24; 204/155; 250/528, 529, 530; 219/7.5, 10.43

[56] References Cited

UNITED STATES PATENTS

| | | | |
|---|---|---|---|
| 2,013,653 | 9/1935 | Hoke | 75/11 UX |
| 2,686,864 | 8/1954 | Wroughton et al. | 219/7.5 |
| 3,153,820 | 10/1964 | Criner | 164/250 UX |
| 3,363,081 | 1/1968 | Noiret | 219/7.5 X |
| 3,705,789 | 12/1972 | Keller | 219/10.43 X |
| 3,842,895 | 10/1974 | Mehrabian et al. | 164/49 |

FOREIGN PATENTS OR APPLICATIONS

| | | | |
|---|---|---|---|
| 526,455 | 6/1956 | Canada | 164/49 |

*Primary Examiner*—Ronald J. Shore
*Assistant Examiner*—John E. Roethel
*Attorney, Agent, or Firm*—Clarence A. O'Brien; Harvey B. Jacobson

[57] ABSTRACT

A method of altering the physical properties of materials by applying to the materials in their fluid states the magneto magnetic energy of the north and/or south pole of a magnet. Application of the magnetic north pole to molten metal causes the cooled metal to exhibit a smoother, finer surface, a finer grain structure and increased break strength.

11 Claims, 6 Drawing Figures

Fig. 1
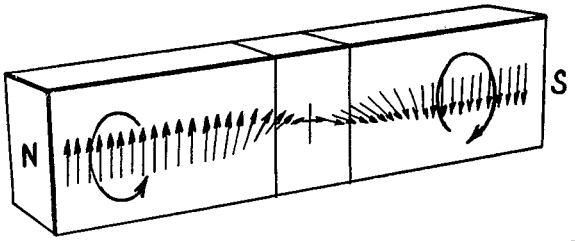
Fig. 2
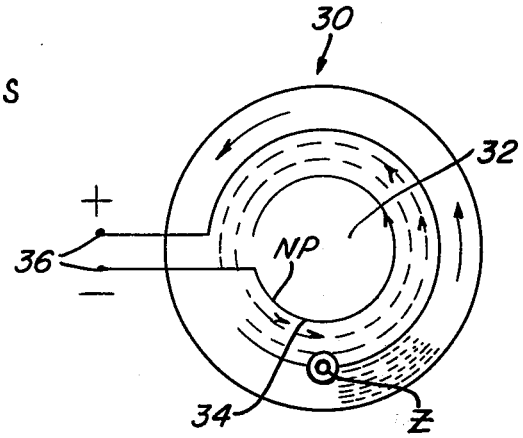
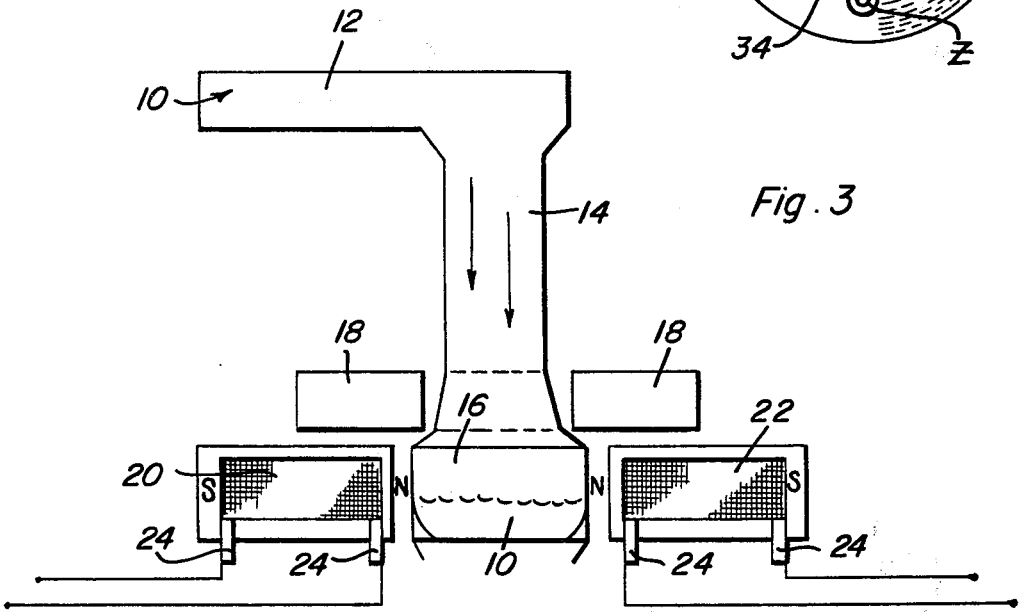
Fig. 3
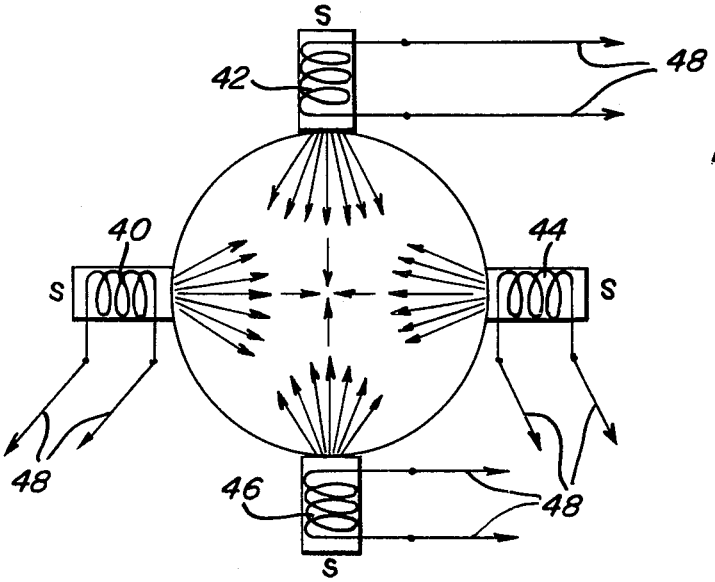
Fig. 4

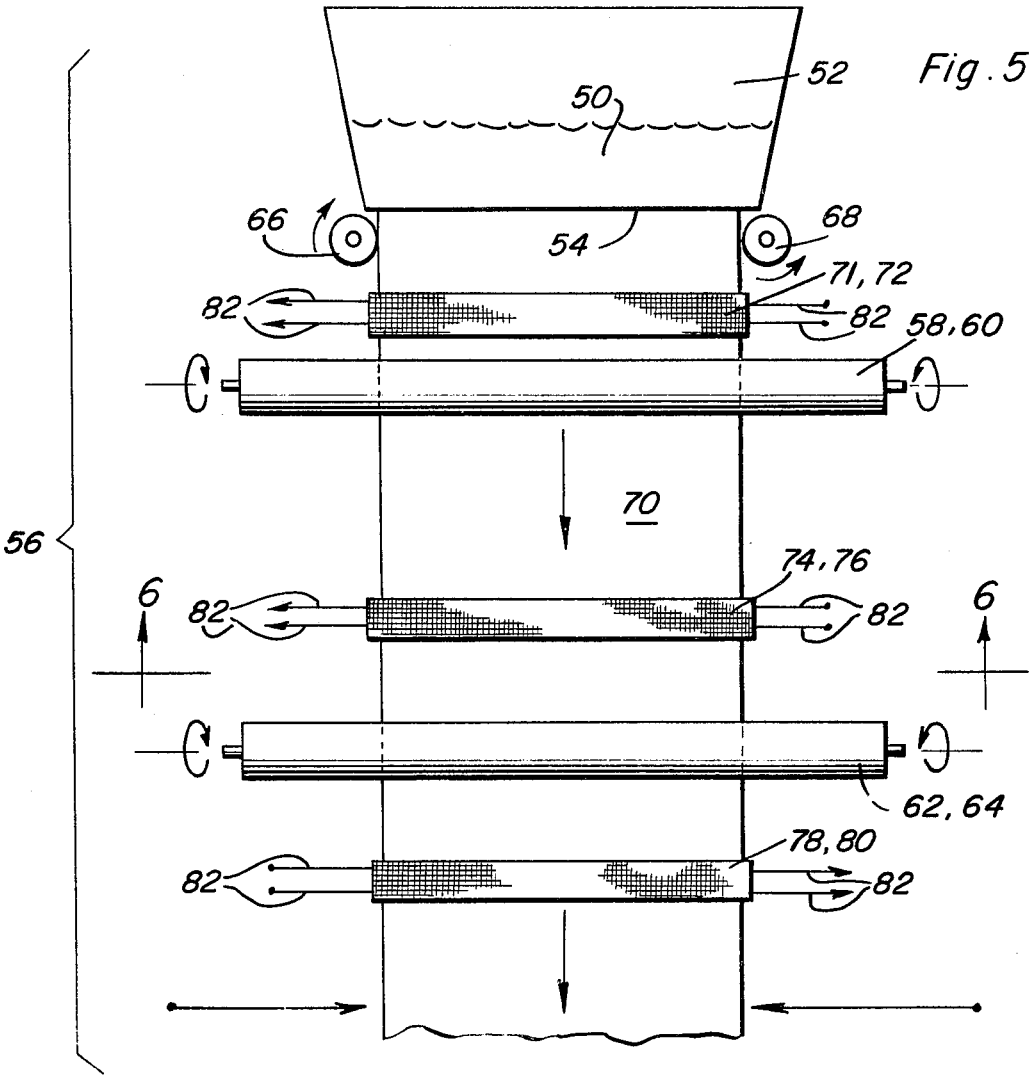
Fig. 6
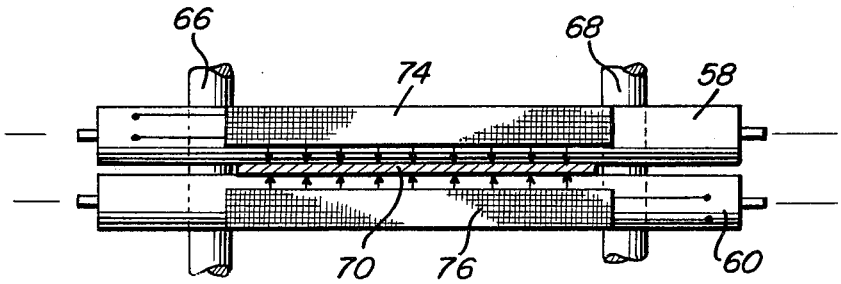

MAGNETIC FIELD EXPANSION AND COMPRESSION METHOD

The present invention relates to the application of magnetic energies and, more particularly, to the application of the respective energies of the north and south magnetic poles to alter the physical state of materials.

The common belief over the years relating to magnets has been that the two magnetic poles, north and south, are homogenous and that they emanate the same potential type of energy. This belief has now been found to be a misconception — the two poles of a magnet are in fact totally different in electrical potential and effect — and the application of the respective poles to materials has been found to produce quite different results.

The north pole (which is defined as the south-seeking pole) is now believed to provide a negative form of energy while the south pole (which is defined as the north-seeking pole) is believed to provide a positive form of energy. To support this discovery, it has been found upon examination of the electron paths associated with the fields surrounding the respective poles (see FIG. 1) that the south pole end of a magnet provides a right hand spin of electrons, i.e., a clockwise rotation of electron movement, as contrasted with the north pole electron spin, which presents a left hand spin or counter-clockwise rotation of its electron field. It has further been observed that the lines of magnetic energy leave the south pole to re-enter the magnet at the Block wall where a 180° phase change takes place, then leave the Block wall to become the north pole energy and re-enter the magnet at its north pole.

In the context of the present invention, these newly appreciated properties of the magnetic poles are applied in a process such that when the north pole magneto magnetic energies, i.e. magnetic energy derived from a magnet as opposed to some other source, are directed to, at or through fluid-type materials, such as molten metals, the molecules of the fluid are brought closer together and certain physical properties of the material are altered. For example, when the molecules of molten metal are brought closer together the result is a finer grained, more compressed, smoother surfaced metal is produced. On the other hand, south pole energy is an expanding type of energy causing the molecules of a molten metal to move further apart with the result that the metal becomes rougher in texture and more porous in nature. These differences in physical effect upon fluid-type materials caused by the respective magnetic pole energies can be applied in a controlled and advantageous manner to achieve specific desirable results.

Accordingly, it is an object of the invention to provide a process for treating fluid-type materials to compress or expand their molecular structure and thereby to alter certain of their physical properties.

It is another object of this invention to provide a process for treating molten metal to control the texture, grain and surface condition of the cooled metal.

It is still another object of this invention to provide a process for treating magnetic materials to enhance their ability to store data, magnetic bits, codes, information, and the like.

It is yet another object of the invention to provide a method for treating fluid-type materials to change the gravity weight thereof and, by detection and measurement of the weight change, to analyze the elemental make-up of the material.

Other objects and advantages will become apparent from the following description and appended claims taken in conjunction with the accompanying drawings.

FIG. 1 is a schematic representation of the electron paths around the north and south poles of a bar magnet.

FIG. 2 is a plan view of a semi-flat wound coil useful as the magnetic energy source in the present invention.

FIG. 3 schematically illustrates an exemplary means for exposing fluid-type materials to the energies of the respective magnetic poles.

FIG. 4 is a plan view of an alternative arrangement of magnetic energy sources about a fluid-type material container.

FIG. 5 is a plan view, in schematic form, of an exemplary means for exposing molten metal to the energies of the respective magnetic poles and for forming the exposed metal into sheet form.

FIG. 6 is a sectional view taken substantially along line 6—6 in FIG. 5.

In its broadest aspects, the present process comtemplates passing fluid-type materials through the magnetic field emanating from the north or south poles of a magnet to alter certain of the physical properties of the materials. One preferred embodiment involves application of magnetic energies to a molten metal poured or otherwise directed through the magnetic field. It has been found that the products resulting from cooling and forming exposed molten metal have a finer, i.e., smoother, finish and are stronger when passed through a magnetic north pole field and are softer, more porous and weaker when exposed to a south pole field. In addition to molten metals, other fluid-type materials are encompassed by the present invention and include, but are not limited to, fluid-type non-metals employed in the forming of crystals and/or the growing of synthetic gem stones. Further, the invention is particularly useful with fluid-type magnetic materials to improve and enhance their ability to hold or retain information bits, i.e., to improve the magnetic storage capacity of such materials for use in computers and the like.

Referring to FIG. 3, there is illustrated a typical means for exposing fluid-type materials to the energy of a magnetic pole. For simplicity of description, the present process will be described in connection with molten metals as the fluid-type materials, although it will be appreciated that the same principles apply equally to other such materials. FIG. 3 illustrates a tubular inlet 12 through which the molten metal 10 may enter and then flow downwardly through guide 14 into tank 16 in which the metal is exposed to the appropriate magnetic field, depending upon the desired results. As the molten metal moves through guide 14, it passes between cooling coils 18 surrounding the guide to initiate the cooling and solidification of the molten metal 10. Electromagnets 20, 22 are disposed on opposite sides of tank 16 with their respective north poles facing inwardly, i.e., adjacent tank 16. Alternatively, if it is desired to expose the molten metal to the magnetic south pole, then electromagnets 20, 22 would be disposed with their respective south poles facing inwardly. The bottom of tank 16 is open to allow flow of the molten metal 10 therefrom. Inasmuch as the molten meltal is exposed to the magnetic energy only during the time it is in tank 16, the tank outlet means (not shown), e.g., a valve or other flow metering device, is one convenient means for controlling the molten metal residence time in the tank. Molten metal leaving tank 16 may be suitably treated, worked or formed in accordance with the desired ultimate product. Electromagnets 20, 22 are conventionally wound with square wire 24 to allow the passage of a coolant through the wire to keep the magnets cool and thereby allow continuous operation. Wires 24 are connected to a suitable power source to excite and power the electromagents. Suitable insulation material, not shown, may be interposed between the magnets and the tank 16 to safeguard the magnets from the heat emanating from the tank.

It will be appreciated that the magnetic energy source need not be electromagnets, but may suitably comprise conventional solid state magnets or metal or air core flat coils, or the like. A conventional solid state magnet is shown in FIG. 1. FIG. 2 illustrates a semi-flat wound coil 30 which may have a metal or air core center 32. Coil windings 34 terminate at appropriate power source connections 36. When a negative voltage is applied to the negative terminal 36, the center core section of the windings becomes the magnetic north pole NP of the magnet and Z indicates the zero point or point of no measurable amount of either north or south magnetic pole. A coil magnet 30 may be employed as the magnetic source in lieu of electromagnets 20, 22 in FIG. 3, in which case tank 16 may be at the core 32 of the coil. FIG. 4 illustrates still another exemplary magnetic field source arrangement around tank 16. In this arrangement, four electromagnets (or solid state magnets) 40, 42, 44, 46 are used instead of the two magnets 20, 22 shown in FIG. 3. Magnets 40, 42, 44, 46 are preferably located at 90° spaced intervals around the tank 16 with their north (or south) poles disposed inwardly adjacent the tank. Wires 48 lead from each of the electromagnets to suitable power sources. For greater magnetic field uniformity, it is desirable to use pairs of opposing electromagnets as shown in FIG. 4, i.e., pair 40, 44 and pair 42, 46. This arrangement adds to the molecular compression or expansion of the material attainable with the present process. Thus, it can be appreciated that neither magnet type nor magnet configuration constitutes a particularly critical consideration in the present process.

On the other hand, magnetic field strength and duration of exposure to the magnetic field are the important parameters in achieving any particularly desired degree of compression or expansion. In this connection, it is observed that any fluid material will react to a strong enough magnetic field to alter its molecular structure by compression or expansion. The energy quantum necessary to effect the desired change in molecular structure will vary depending upon the material and the degree of change desired, as well as upon the duration of exposure to the magnetic field. Generally, magnetic energy strength to achieve expansion or contraction of fluid-type materials should be in the broad range from 1,000 gauss to 1 megagauss and more usually, from 30,000 to 100,000 gauss. Since the energy actually applied varies directly with the amount of material exposed and the results to be achieved, the energy requirements for any particular application differ from the requirements for any other type of application, but are generally predictable once the desired results are known.

Like the requirement for energy, the exposure time during which the magnetic energy is applied varies with the amount and type of material, the energy of the magnetic field and the results sought to be achieved. Thus, the time can vary from as little as 1/10 second per cubic yard of metal sheet to hours in the application of magnetic energy to aid in crystal growth. Exposure time varies directly with the intensity of the result to be achieved and inversely with the energy of the magnetic field. As guideposts for the application of magnetic pole energies, it has been observed that with a given quantity of a known material, the same magnetic effect can be achieved with twice the magnetic field strength for half the time as with half the magnetic energy for twice the time. In other words, the exposure time-magnetic energy relationship is inverse and predictable.

The compressive effect of the north pole upon the molecular structure of neutral, non-ferrous, non-magnetic molten metals has been observed to cause finer grains, smoother surface and improved metal strength in the finished metal product. Without wishing to be bound to any particular theory, it is believed that in molten metals, as in other fluid-type materials, the atoms of the molecules are in a state of relative excitement—moving about at relatively high speeds due to the elevated temperatures. The negative north pole acts to polarize these atoms within certain of the electron shells of the excited atoms. The left hand vortex spin of the north pole magnetic energy, counter-clockwise in direction, effects a tightening of the bonding of the atoms within the molecular structure. Upon cooling or hardening, the magnetic pole effects of compression (north pole) or expansion (south pole) which were induced in the material when in the fluid or excited state are fixed. The faster the cooling or hardening takes place, the more pronounced are the induced magnetic effects and, in the case of the north pole energies, the closer bound are the atoms and the harder and smoother is the resulting metal. However, too rapid cooling is detrimental to the physical properties of the resulting metal, e.g., brittleness is increased, and, therefore, the cooling rate must be carefully selected with both the induced magnetic effects and the physical metallurgical properties of the cooled metal taken into account. Thus, by carefully controlling the cooling rate, the physical effects resulting from exposure to magnetic pole energies can be tailored. For maximum control of induced magnetic effects plus resulting metallurgical properties, it is preferred to continue the exposure of the metal to the magnetic field during cooling.

South magnetic pole effects can be explained on the same fundamental basis. When the south pole right hand vortex spin, clockwise in direction, is applied to a fluid-type material, the induced effect is expansion rather than compression, thus loosening the bonding of the atoms within the molecular structure. Upon cooling or hardening, the south pole effects become fixed with the observable result, e.g., with molten metals, that the resulting metal product is softer or weaker in strength with a grainier and more porous texture.

FIGS. 5 and 6 show still another embodiment of the present invention wherein the molten metal can be exposed to the appropriate magnetic pole energy during cooling and forming. Molten metal 50 in molten metal tank 52 is metered through the outlet 54 of the tank to the processing or forming means 56, such as a series of roller pairs 58, 60 and 62, 64. As the molten metal initially passes from outlet 54, it is caused to pass through shaping rolls 66, 68 to laterally constrain the sheet 70 which is formed. Thereafter, in conventional manner, the metal passes sequentially between roller pairs 58, 60 and 62, 64 whereby the final dimensions of sheet 70 can be established. It will, of course, be appreciated that the roller mill is conventional in all respects and can comprise any number of roller pairs necessary to appropriately size sheet 70. As the molten metal 50 is rolled and simultaneously cools, it passes between magnet pairs which are in vertical and horizontal registry, with one member of each pair above the sheet 70 and the other member of each pair below the sheet 70. In transverse extent, each of the magnets should be at least as wide as the sheet 70 to avoid edge effects. The magnets may be electromagnets, solid state magnets, coiltype magnets or any other suitable type, as hereinfore described. Depending upon whether it is desired to compress or expand the atomic particles of the metal, the magnets will have their north (compress) or south (expand) poles adjacent the sheet. Magnet pairs 71, 72 and 74, 76 and 78, 80 shown in FIG. 5 are electromagnets having lead wires 82 connected to a suitable power source to excite the magnets. The number of magnet pairs used, their spacing along the roller mill and the strength of the magnetic fields are selected according to the degree of compression or expansion desired. Where the magnets have their respective north poles adjacent to and facing sheet 70, there is a tightening or compressing action forcing the atomic particles of the metal closer together. On the other hand, when the magnets have their respective south poles adjacent to and facing sheet 70, there is a widening or broadening of the bonding of the atomic particles of the metal. In a third alternative, the magnets may be so disposed that in each magnet pair, one magnet has its north pole adjacent one side of the sheet 70 while the other magnet has its south pole adjacent the other side of the sheet 70. In this case, the metal atoms on one side of the sheet will undergo compression while the atoms on the other side of the sheet will undergo expansion. It will be appreciated that in the practice of the present process, the molten metal may be any metal at all, but is preferably a non-ferrous, non-magnetic metal. If metal 50 is magnetic, location of the magnets 71, 72, 74, 76, 78, 80 creates a substantial problem. Specifically, the magnets must be located close enough to sheet 70 to provide the desired magnetic field strength yet sufficiently distant that they do not, by attraction, deform the sheet 70 or otherwise adversely affect its smooth passage through the roller mill.

The following Examples are illustrative of the practice of the present invention.

EXAMPLE I

A number of medium grade aluminum rod and sheet samples, each weighing about ½ pound, were placed individually into a furnace at 1400°F to convert the solid aluminum to molten form. The molten aluminum samples were poured into clay retorts. Three of the retorts were selected and identified as Nos. 1, 2 and 3, respectively. Retort No. 1 was separated from the other two and used as a control. Each of the retorts contained an aluminum sample measuring 2½ inches square, ½ inch deep and weighing about 2¾ ounces.

The sample in retort No. 2 was placed in the field of the magnetic north pole having a gauss strength of 4000 gauss for 60 minutes by lowering the north pole end of the magnet until it was within 1/16 inch of the molten aluminum. Following exposure, the sample was permitted to air cool at a room temperature of 79°F. In the same manner, the sample in retort No. 3 was exposed to the 4000 gauss south pole of the magnet for 60 minutes after which the sample was allowed to air cool at 79°F. The control sample in retort No. 1 was not exposed to any magnetic field. It also was air cooled at 79°F.

The surfaces of each of the samples were visually inspected following cooling. The control sample had the characteristic aluminum oxide scale formed over its surface. The north pole exposed sample from retort No. 2 was smooth and showed no indication of any scale on its surface. The south pole exposed sample from retort No. 3 was porous by microscopic comparison with the north pole exposed sample.

Each of the samples was broken roughly into halves by placing the lower half of the sample in a vise and then, using a flat hydraulic pressure pump, applying pressure to a contact metal plate placed against the upper half of the sample. The pressure necessary to break each sample was measured and noted and is set forth below:

| Sample | Pressure (psi) |
|---|---|
| Retort No. 1 (Control) | 45 |
| Retort No. 2 (North Pole) | 60 |
| Retort No. 3 (South Pole) | 30 |

This break strength test was repeated 10 times on other sets of three samples each prepared in the same manner as described herein. While the breaking pressure varied from test to test, the variation was never more than 20% from the values herein presented. Moreover, in every test, the pressure necessary to break the north pole exposed sample always exceeded the break pressure for the control sample which, in turn, always exceeded the break pressure for the south pole exposed sample.

The broken ends of each of the samples were examined at 50X under a microscope to observe the grain structure. It was consistently noted that the north pole exposed samples had the finest (smallest) grains, that the south pole exposed samples had the coarsest (largest) grains, and that the grain size of the control sample was intermediate the fine and coarse grains.

EXAMPLE II

The tests of Example I were repeated except that each test used only two samples, a control sample and a magnetic field exposed sample. The latter was prepared by employing two 4000 gauss magnets. The north pole of one magnet was located immediately below and adjacent the sample as it cooled while the south pole of the other magnet was disposed immediately above and adjacent the sample. Exposure was continued for 60 minutes. When the sample finally cooled to about 80°F, it was observed that there was no scale on its surfaces. Upon breaking the control and exposed samples and examining the broken ends at 50X magnification, it was noted that the grain size of the north pole side of the sample was relatively fine and that the grain size gradually increased through the ½ inch thickness of the sample. The coarsest grains were on the south pole side of the sample. As with Example I, breaking pressure was measured. The break strength of the exposed sample was about 35 psi on an average (based on 70 tests), consistently less than the control sample but about 12–15% greater than the breaking pressure for a south pole exposed sample.

EXAMPLE III

Example I was repeated except that the samples were placed between rollers and rolled during cooling. After cooling and breaking, it was difficult to examine the grain size due to grain compression caused by the rolling. However, upon using 100X magnification, it was apparent that the grain size differences noted in EXample I remained unchanged, i.e., north pole exposed grains were the finest while south pole exposed grains were the coarsest.

The application of north and/or south pole magnetic energies to fluid-type materials has other unique effects. For example, the application of north pole magnetic energy will increase the physical weight of a fluid-type material, whereas application of south pole magnetic energy will decrease the physical weight of the exposed material. SIgnificantly, the weight change caused by the magnetic field is different for each element, thus permitting qualitative identification of the components of the fluid-type material by careful measurements of the weight change.

For example, if a test tube or other container is three-quarters filled with a fluid-type material and suspended on a line of thread or wire and one end of the thread or wire attached to a sensitive scale, the weight change due to the magnetic field exposure can be noted and measured. Initially, the weight of the suspended test tube with its fluid-type material content is measured by the scale in still air. Thereafter, one or more magnets of known gauss strength are brought closely adjacent the tube with the north or south pole immediately adjacent the tube. After a period of time, the change in physical weight becomes apparent from and is registered on the scale. North pole exposure increases the physical weight, whereas south pole exposure decreases the physical weight of the fluid-type material.

It is believed that the weight change is a result of the compressing or expanding action of the north or south poles on the atoms of the elements in the tube. As the magnetic pole is brought adjacent the tube, the magnetic field polarizes the tube contents by aligning the atoms and the molecules and expands or contracts the atoms in their shells. This polarization alters the gravity weight of the atoms while in the magnetic field. The weight change may last for only a few seconds, as in the case of a liquid such as water, or for a matter of days. For example, a sample of aluminum film 1mm thick by 8mm wide was exposed to the north pole of a magnet having a strength of 40,000 gauss for 5 minutes. The activity of the atoms of the aluminum was substantially increased resulting in a measurable weight increase of 0.05%. At the same time, a like sample of aluminum film was exposed to the south pole of a magnet having a strength of 40,000 gauss for 5 minutes. A measurable weight loss of 0.04% was observed.

Still another effect of applying magnetic fields to fluid-type materials is noted in connection with the treatment of chemically grown crystals, flame grown crystals (e.g. the ruby rod), RF induced heat grown crystals (e.g. lasers), synthetic gems, diamonds, crystals grown for computer memory banks and the like. when these materials are exposed to the north or south pole magnetic energies, as described herein, their atoms are compressed or expanded in a manner similar to that noted in connection with molten metals. To prepare crystals exposed to the north or south pole of a magnetic field, raw material powders may be introduced into an appropriate furnace wherein heat from an RF induction coil causes the powders to liquefy and to fall to the bottom of the furnace. In this manner, there is a continuing build-up or growth of the crystal in the furnace. An appropriate magnetic field, such as that described in connection with FIGS. 3 and 4, surrounds the furnace and imparts magnetic energy to the atoms of the crystal to induce compression or expansion, as hereinbefore described. One incident of such exposure is that the optic qualities of crystals prepared in this manner can be altered and the ability of magnetic materials to store information bits can be increased.

While the present invention has been described with reference to particular embodiments thereof, it will be understood that numerous modifications can be made by those skilled in the art, without actually departing from the scope of the invention. Accordingly, all modifications and equivalents may be resorted to, which fall within the scope of the invention as claimed.

What is claimed as new is as follows:

1. A method for altering the physical properties of a material capable of assuming a molten, fluid state comprising the steps of:

heating said material to the molten state, applying to said molten material magnetic energy in the range 1,000 to 1,000,000 gauss from only one magnetic pole for a time sufficient to achieve the desired alteration in properties and cooling said molten material to a solid state, said magnetic energy being applied prior to the passage of said material into its solid state form.

2. The method defined in claim 1 wherein said one magnetic pole is the north magnetic pole.

3. The method defined in claim 2 wherein said material is metal and following the passage of it into its solid state said metal exhibits an improved break strength and relatively finer grain structure.

4. The method defined in claim 1 wherein said one magnetic pole is the south magnetic pole.

5. The method defined in claim 4 wherein said material is metal and following passage of it into its solid state it exhibits decreased break strength and a relatively coarser grain structure.

6. The method defined in claim 1 comprising the additional step of:

mechanically working said material subsequent to said heating step to form said material into a predetermined shape.

7. The method defined in claim 1 wherein said applying step occurs prior to said cooling step.

8. The method defined in claim 1 wherein said applying step occurs during said cooling step.

9. The method defined in claim 1 wherein said material is selected from the group consisting of metals, non-metallic crystals and magnetic materials.

10. The method defined in claim 1 wherein said material is aluminum and wherein said applying step comprises applying a magnetic energy of 4,000 gauss for a period of 60 minutes.

11. The method defined in claim 1 wherein said material is a magnetic material capable of assuming a magnetic state corresponding to the value of an electrical signal applied thereto, said properties being altered including enhancement of the capability of said magnetic material to store the values of electrical signals, such as data bits and the like, applied thereto.

* * * * *